United States Patent [19]

Schneider

[11] Patent Number: 4,864,785

[45] Date of Patent: Sep. 12, 1989

[54] EARTHQUAKE RESISTANT MOBILE HOME SUPPORT

[76] Inventor: Jimmy R. Schneider, 3562 Don Juan Dr., Carlsbad, Calif. 92008

[21] Appl. No.: 145,518

[22] Filed: Jan. 19, 1988

[51] Int. Cl.[4] ..... E02D 27/34

[52] U.S. Cl. ..... 52/167; 52/299; 52/742; 52/DIG. 11

[58] Field of Search ..... 52/143, 292, 299, 167, 52/DIG. 11, 742

[56] References Cited

U.S. PATENT DOCUMENTS

| | | | |
|---|---|---|---|
| 2,344,383 | 3/1944 | Alexander et al. | 52/292 X |
| 3,751,866 | 8/1973 | Renchen | 52/DIG. 11 X |
| 3,830,024 | 8/1974 | Warnke | 52/DIG. 11 |

*Primary Examiner*—Carl D. Friedman

*Attorney, Agent, or Firm*—Brown, Martin, Haller & McClain

[57] ABSTRACT

A mobile home support system is disclosed which uses a plurality of stepped elongated supports, preferably made of railroad ties secured together. The individual supports are placed beneath a mobile home with the mobile home support beams preferably secured to the supports. The supports are disposed at various angles beneath the mobile home structure to provide effective resistance to loss of support by lateral movement of the mobile home under the influence of displacement forces generated by ground tremors, regardless of the direction from which the displacement force is generated. The system has received approval for earthquake resistance support from the State of California. Also disclosed is the corresponding method of providing support to a mobile home in the presence of displacement forces generated by ground tremors.

19 Claims, 2 Drawing Sheets

EARTHQUAKE RESISTANT MOBILE HOME SUPPORT

FIELD OF THE INVENTION

The invention herein relates to supports for mobile homes.

BACKGROUND OF THE INVENTION

In the past few years, mobile homes have become a significant part of the residence inventory in the United States. Mobile homes, which were once considered suitable only for temporary and barely adequate residential use, have now become permanent residences for large segments of the population. This has been due to a number of factors, not the least of which are the improvements in mobile home construction, design and furnishing and the cost of conventional dwelling. The transition of mobile home parks into the equivalent of tradition neighborhoods and communities has also been an important factor.

The mobile home frame is built of longitudinal beams such as I-beams or C-beams supporting the mobile home floor and the rest of the mobile home structure. In conventional practice a number of small concrete pads are poured in place or otherwise positioned on the ground in the location where the mobile home is to be placed. On each of these pads is placed a support, with the supports and pads being aligned with the longitudinal beams of the mobile home. The mobile home is then placed on the supports so that the beams rest on the top of the supports and the supports in turn rest on the pads. The supports can be made of different heights to allow the mobile home to be level even though the ground beneath the mobile home may have slight irregularities. Commonly the supports, which are generally similar to an automobile jack stand, are on the order of 1 to 2 feet (0.3 to 0.6) in height. The number of supports under a mobile home will be determined by the size and weight of the mobile home as well as the number of longitudinal beams in the mobile home frame.

In many areas of the country where there are large concentrations of mobile homes, there is also a history of past and current earthquake activity, the most notable such area being California. Small tremors are quite common and more severe shocks (up to about 6.0 on the Richter Scale) are not uncommon, as is evidenced by the Palm Springs earthquake of 1986 and the Whittier earthquake of 1987. Most such earthquake are accompanied by large numbers of foreshocks and aftershocks of varying intensity.

It has been found that in such earthquakes, among the most severely damaged structures are mobile homes. It is common for a much larger proportion of mobile homes in a quake area to be damaged severely than the corresponding proportion of conventional foundation homes. Primarily this is due to the inability of the conventional mobile home supports to support the mobile home adequately during the tremor. The support failure normally occurs in either of two ways: collapse of the supports themselves which allows the mobile home to fall, or vibration which causes the mobile home to move laterally off of the supports and fall.

Past efforts to provide earthquake resistance to mobile home support have involved the design of complex structures which are intended to provide support to several parts of the structure in several directions. Typical are those supports shown in U.S. Pat. Nos. 4,562,673; 4,546,581; 4,522,000; 4,417,426; 4,373,307; 4,348,843 and 4,261,149. These have been generally unsatisfactory because they are still susceptible to bending or buckling, they do not necessarily compensate for lateral motion of the mobile home and they are complex and costly to fabricate and install. In addition, the conventional supports are prone to rust, particularly in the humid environment found under most mobile homes, especially those surrounded by skirting. The rusted metal supports lose most of their strength and easily fracture when subjected to the forces of an earth tremor. Because of these shortcomings, the prior art structures usually cannot be approved by responsible earthquake safety authorities, such as the Department of Housing and Community Development in the State of California.

It would therefore be most advantageous if there were a mobile home support of relatively simple structure which could provide effective support during common earth tremors, to minimize or eliminate damage to mobile homes from the tremors, and which would be simple and economical to construct and install. It would also be of real importance for the support to be sufficiently effective that it would qualify for approval from recognized earthquake safety authorities.

BRIEF SUMMARY OF THE INVENTION

In one aspect, the invention herein is a mobile home support system which is simple in structure, made of readily available and inexpensive materials, easily installed under a mobile home and so effective that it has been approved by the Department of Housing and Community Development of the State of California under the appropriate California earthquake protection regulations. The invention is a support system for a mobile home structure which will provide support in the presence of displacement forces generated by ground tremors, which comprises a plurality of support members, each of which comprises a plurality of elongated blocks; the blocks being stacked in abutting relationship to form a generally stepped structure with a broader base under a narrower top; the plurality of support members being positioned beneath the mobile home structure in a generally horizontal plane with the structure resting thereon; and the plurality of support members being positioned in the horizontal plane with the longitudinal axis of some of the members being aligned at angles of 45° and 90° to the axes of other of the members.

In preferred embodiments, groups of the individual support members will be angled at 90° to other groups and the overall spread of angles can be from 30° to 90°. The support blocks are preferably made of wood or a material which has compression and resilience properties substantially equivalent to wood. Also, in preferred embodiments, the members are made of stacked railroad ties which are secured together and which may be additionally secured to the longitudinal beams of the mobile home.

In another aspect, the invention comprises a support member for a mobile home structure which will provide support in the presence of displacement forces generated by ground tremors, which comprises a plurality of elongated blocks, the blocks being stacked in an abutting relationship to form a generally stepped structure with a broader base and a narrower top.

In yet another aspect, the invention comprises a method of providing support for a mobile home structure which will resist displacement forces generated by ground tremors, which comprises assembling a plurality of support members, each of which comprises a plurality of elongated blocks; the blocks being stacked in n abutting relationship to form a generally stepped structure with a broader base and a narrow top; positioning the plurality of support members beneath the mobile home structure in a generally horizontal plane with the longitudinal axes of some of the members being aligned at angles of 45° to 90° to the axes of others of the members; and placing the mobile home structure on the support members.

DETAILED DESCRIPTION AND PREFERRED EMBODIMENTS

Figure 4:
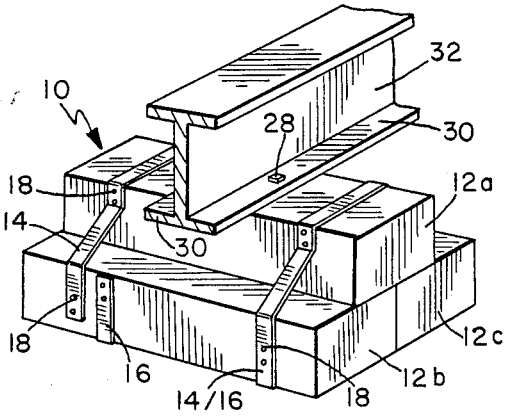
FIG. 4 is a perspective view of a single support member of the present invention with a fragment of a mobile home support beam shown secured thereto.

The invention herein will be best understood by reference to the drawings, beginning with FIG. 4.

FIG. 4 illustrates a typical individual support member which is constructed of elongated blocks 12*a*, 12*b*, and 12*c*. These are preferably elongated wooden timbers with typical dimensions of 6" by 8" (15 by 20 cm) in cross-section and 48" to 60" (120 by 150 cm) in length. The cross-sectional dimensions of width and depth are not critical, however, and can range from about 6" to 12" (15 by 30 cm) for either dimension. Thus, the commercial timbers commonly referred to as "6×6s", "10×10s" and the like are quite satisfactory. Of particular suitability are railroad ties or timbers having sectional dimensions of railroad ties.

The length dimensions are also not critical, except that lengths of less than 48" (120 cm) may not provide an adequate assurance of resistance to lateral motion, particularly when set at an angle to the mobile home beams, and normally will not provide sufficient load bearing capability unless spaced very close together. Lengths greater than about 72" (180 cm) may not provide significant additional resistance and are difficult to install under a mobile home, particularly where individual supports are in close proximity or the mobile home support beams are closely spaced. Lengths of 48" to 54" (120 to 140 cm) have been found to be quite satisfactory.

Preferably the blocks 12 are made of wood or a solid material which has the compressive and resilient properties substantially equivalent to those of wood. The particular type of wood is not critical, although it should be of moderate hardness, neither so soft as to compress unduly under the weight of the mobile home nor so hard to be difficult to drive nails or lag screws into or to have bolt holes in. Quite satisfactory are the types of wood which have commonly been used for railroad ties, which include cedar, fir, chestnut, elm, oak and redwood. Some of these woods are relatively resistant naturally to decay by contact with the ground and/or the natural elements. In general, however, it will be desirable and in many cases necessary to have the wood saturated with a preservative such as creosote or similar preservatives. Particularly preferred is a commercial preservative called chemonite, which is an ammoniacal cooper arsenite which has the wood preservative properties of creosote but which does not have creosote's sticky texture and disagreeable odor, both of which are undesirable in a residential setting.

Figure 3:
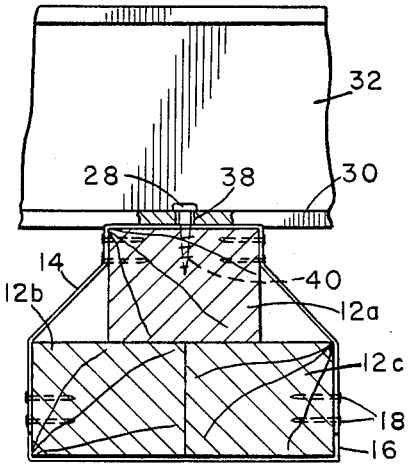
FIG. 3 is a sectional view taken on line 3—3 of FIG. 2.

The basic stepped configuration of the individual support members of the present invention is illustrated in FIGS. 3 and 4. The individual blocks 12*a*, 12*b* and 12*c* are butted together and then secured in position by straps 14 and 16 which are secured with fasteners 18, such as nails, spikes or lag screws. The straps 14 and 16 are made of heavy gauge metal, commonly galvanized steel. (As with all of the components of the support member, such as the wood and fasteners, the galvanized steel will be of a grade which meets applicable government code standards.) Typically, they are 1" to 2" (2.5 to 5 cm) in width and about 0.025" to 0.05" (6 to 12 mm) in thickness. They must be sufficiently thick to be able to secure the blocks 12 firmly, but not so thick that they can not be properly bent to conform to the shape of the blocks as illustrated in FIGS. 3 and 4.

In FIG. 4 the straps 14 and 16 are shown in two configurations: overlapping but not continuous at the left, and continuous (as strap 14/16) on the right. While both configurations can be used on a single support member, in practice normally one or the other will be used exclusively. In either case the strapping, whether continuous or overlapping, will extend completely around the support member.

Those skilled in the art will be readily able to select the proper wood or similar material for the blocks and the proper type and size of metal strapping from materials readily available.

Figure 5:
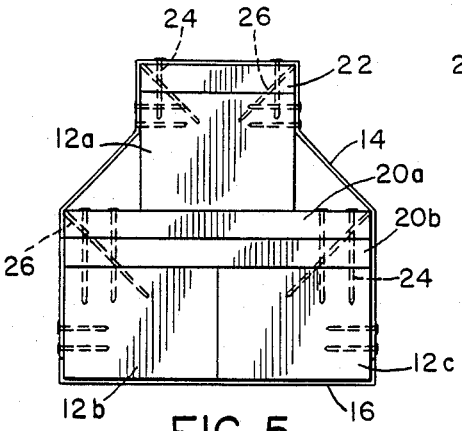
FIG. 5 is an end view of a support member of this invention.
Figure 6:
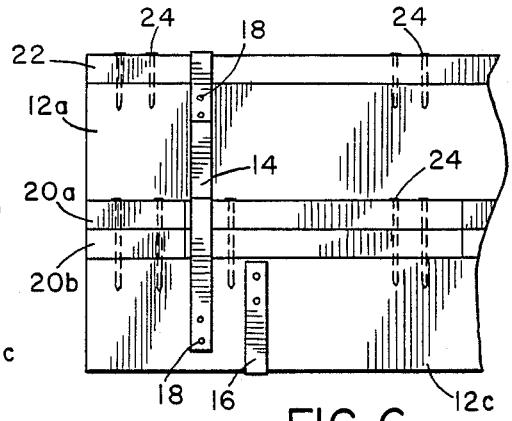
FIG. 6 is a partial side elevation view of the support member of FIG. 5.
Figure 7:
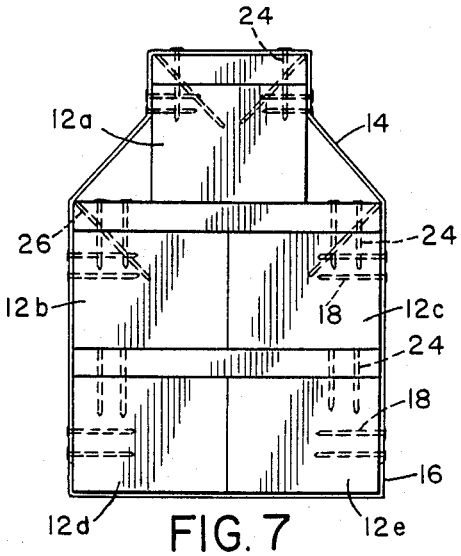
FIG. 7 is an end view of another support member of the present invention.
Figure 8:
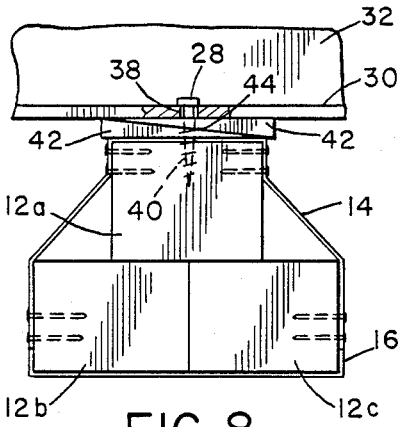
FIG. 8 is an end view of yet another support member of the present invention showing a method of securing the support member to the mobile home support beam.

Other embodiments of the support members of the present invention are illustrated in FIGS. 5 and 8. The embodiment shown in FIG. 5 contains intermediate planks 20*a* and 20*b* and cap plank 22 which may be used to provide additional height for the block where the additional height needed is less than a full height of an individual block. Typically, the planks 20 and 22 will be nominal "2 inch" lumber, which has a thickness of 1.5" (4 cm). The width and length will usually be comparable to the width and length of the blocks 12, although as shown in FIGS. 5 and 7 the widths of the planks 20 may be double the width of the blocks 12 for ease of assembly and to insure structural integrity. The number of planks 20 and 22 used will depend on the additional height needed. The planks 20 and 22 will be secured to the blocks 12 by fasteners 24, some of which are toenailed as at 26, and which are similar to the fasteners 18. The planks will normally be made of the same or a similar type of wood as the blocks.

An alternative embodiment where greater height is needed is shown in FIG. 7, where an additional layer of blocks 12*d* and 12*e* are used. It is possible to add yet another layer of blocks, particularly if they are aligned with three across, where the location of the mobile home has a severely irregular ground profile. If such taller members are used, however, it is recommended that they constitute a relatively small portion of the total number of members used for the mobile home support. A better practice would be to have the ground graded to be more level so that supports of the types shown in FIGS. 5 and 7 can be used throughout.

FIGS. 3, 4 and 8 illustrate means of securing the beams of the mobile home to the support blocks. It is not always necessary to have such direct securement, although it is the preferred practice, since in many cases the weight of the mobile home itself will serve to prevent the home from moving laterally to the extent that it moves off the support structures, particularly where the support structures are placed at varying angles. In the preferred situation, however, the mobile home beams will be secured directly to the uppermost blocks 12*a* by means of lag screws 28 which are placed through holes 38 in flanges 30 of support beams 32 and screwed securely into block 12*a* as shown at 40. To accommodate for irregularities in the ground level below the mobile home, shims or wedges 42 may be placed between flanges 30 and block 12*a*, driven securely into place and then secured by lag screw 28.

Figure 1:
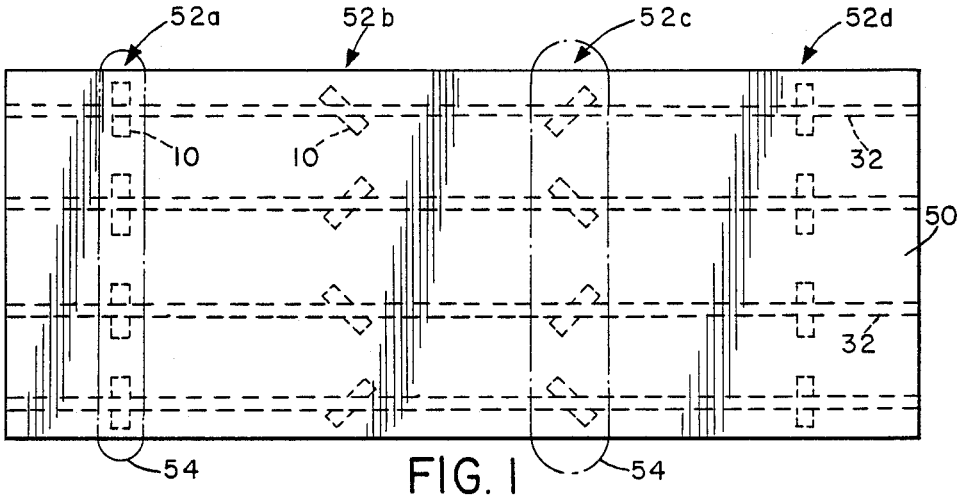
FIG. 1 is a plan view of the floor of a mobile home, showing the longitudinal beams and a number of individual supports of this invention disposed at various angles under the longitudinal beams.
Figure 2:
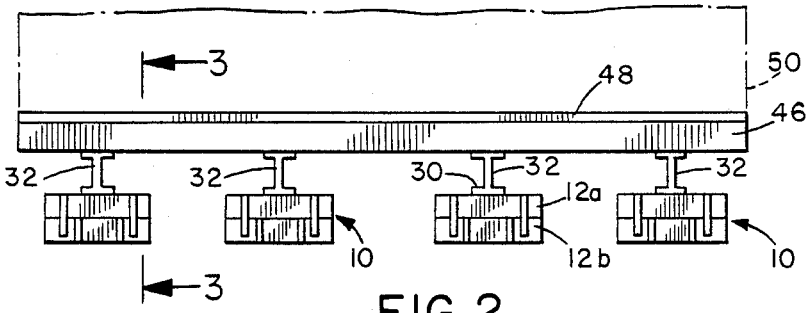
FIG. 2 is an end view of the lower part of a mobile home showing supports of this invention with the mobile home resting thereon.
Figure 9:
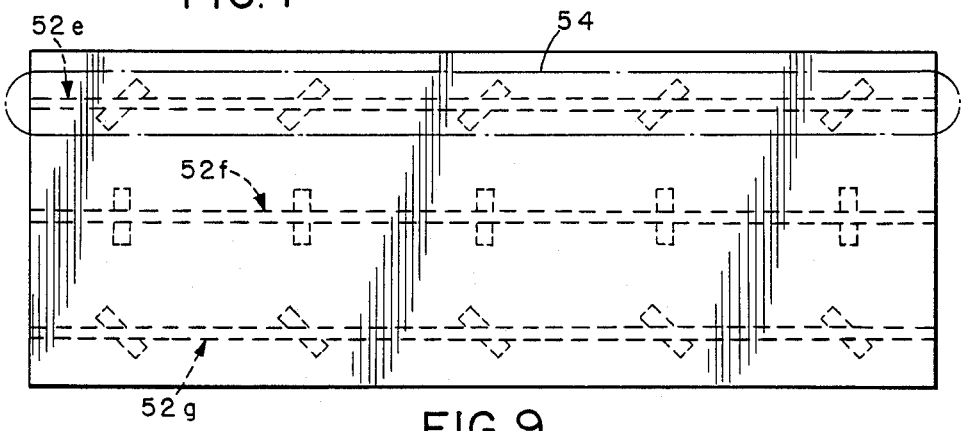
FIG. 9 is a plan view similar to that of FIG. 1 showing a different arrangement of the support members of the present invention under a mobile home.

The overall configuration of the support system of the present invention is shown in FIGS. 1, 2 and 9. FIG. 2, an end view of a typical mobile home, shows longitudinal beams 32 resting on supports 10. Cross beams 46 in turn are secured to the longitudinal beams 32. The flooring 48 is secured to the cross beams 46 and the remainder of the mobile home 50 (shown in phantom) is assembled on top of the flooring 48.

FIGS. 1 and 9 show tow configurations for portioning the individual support members to form the entire support system. There are several groups 52 of support members 10. The groups 52 are defined herein as two or more support members 10 which are adjacent and aligned either laterally to the mobile home as in FIG. 1 or longitudinally as in FIG. 9. The dotted lines 54 in FIGS. 1 and 9 outlines examples of groups 52. The individual supports 10 in a given group are normally aligned substantially parallel with each other as in groups 52*a* and 52*d*–52*g* or they set at angles to one another, preferably 90° angles, as shown in groups 52*b* and 52*c*.

The exact positioning of an individual support member 10 is not critical. However, it is important that there be groups of supports spaced apart and placed at angles to each other under a mobile home as illustrated in FIGS. 1 and 9 or in equivalent patterns, so that regardless of the direction from which the tremor originates, there will be a number of individual supports disposed at not more than 45° from perpendicular to the direction of propagation. Typical orientations with respect to the longitudinal beams 32 are shown in FIGS. 1 and 9, with some groups being oriented at about 90° to the beams 32 and others at about 45°, with the 45° members alternating at about 90° to each other, either individually within the group as in FIG. 1 or with groups alternated as in FIG. 9. Intermediate angles between 45° and 90°, such as 60°, may also be used. Angles less than 45° with respect to the beams 32 are not recommended, since the support for lateral motion of the mobile home is significantly reduced.

The spacing of the support members is not critical, as long as there are enough members beneath a mobile home to support the load adequately but not so many that they interfere with each other or with access to the space below the home. Lateral spacing will depend on the spacing of the home's frame beams 32, which is usually about 5 to 7 feet (1.5 to 2.1 m). Longitudinal spacing is usually about 10 to 15 feet (3.0 to 4.6 m) on center. Closer spacing is preferred since it offers more support to the home.

As an example of the present system, individual support members of the type shown in FIGS. 3 and 4 were constructed, using railroad ties with a 2×6 plank 22 placed between the single upper tie and the two lower ties, with the ties strapped together with 1.25" (3.2 cm) stainless steel strapping. The support member were tested for compression and shear. Maximum vertical load using a 3.5" (8.9 cm) wide I-beam, 10" (25 cm) high, was 24,000 pounds (10,900 kg), at which time the I-beam began to fail while the support remained intact. Longitudinal shear was tested by applying a longitudinal load to the top tie. The maximum load of 3,400 pounds (1,540 kg) was obtained, with failure determined when displacement of the top tie exceeded 3" (7.6 cm), which represented the bending of the strapping.

Subsequently a system was constructed using supports as shown in FIG. 4 positioned as illustrated as in FIG. 1, with longitudinal spacings of 15 feet (4.6 m) and lateral spacings of 5.5 to 6.5 feet (1.7 to 2.0 m). This was subjected to standard mobile home earthquake bracing tests as defined by the State of California and was found to meet the requirements, of California Administrative Code Title 25, Chapter 2, Article 7.5, "Mobile Home and Manufactured Home Earthquake Resistant Bracing Systems." Included in that approval were support members of the types shown in FIGS. 3 through 8.

It will be evident that there are many embodiments which, while not described above, are clearly in the scope and spirit of this invention. The above description is therefore intended to be exemplary only and the full scope of this invention is to be determined solely by the appended claims.

I claim:

1. A support system for a mobile home structure which will provide support in the presence of displacement forces generated by ground tremors, which comprises:

a plurality of support members, each of which comprises a plurality of elongated blocks;

said blocks being stacked in an abutting relationship to form a generally stepped structure with a broader base and narrower top;

said plurality of support members being positioned beneath said mobile home structure in a generally horizontal plane and with said structure resting thereon; and said plurality of support members being positioned in said plane with the longitudinal axes of some of said members being aligned at angles of 45° to 90° to the axes of others of said members.

2. A support system as in claim 1 wherein said support members are disposed at angles of 45° to 90° to the longitudinal axes of said mobile home structure.

3. A support system as in claim 1 wherein at least some of said support members are disposed at about 90° to the longitudinal axes of said mobile home structure.

4. A support system as in claim 1 wherein at least some of said support members are disposed about 45° to the axis of longitudinal axis of said mobile home structure.

5. A support system as in claim 1 wherein said blocks are made of wood or a material with compression and resilience properties essentially equivalent to those of wood.

6. A support system as in claim 5 wherein said blocks are made of wood.

7. A support systems as in claim 1 wherein at least some of said support members comprise two layers stacked vertically, the upper layer being a single block, and the lower layer comprising two blocks abutting horizontally.

8. A support system as in claim 7 wherein said blocks of said support members are secured in abutting relationship by at least one metal strap secured to the outer sides of said blocks.

9. A support system as in claim 1 wherein said mobile home structure is secured directly to at least some of said support members.

10. A support system as in claim 9 wherein said direct securement is by means of threaded fasteners.

11. A support system as in claim 1 wherein at least some of said support members comprise three layers staked vertically, with the uppermost layer being a single block and the two lower layers being each composed of two or more blocks abutting horizontally.

12. A support system as in claim 1 wherein plank members are disposed between the layers of said blocks to provide overall height variations.

13. A support system as in claim 1 wherein said support members are placed beneath said mobile home structure on centers of 5 to 7 feet laterally and 10 to 15 feet longitudinally.

14. A support system as in claim 1 wherein each of said blocks has a length of 48 to 72 inches and a width and depth of 6 to 12 inches each.

15. A method of providing support for a mobile home structure which resists displacement forces generated by ground tremors, which comprises:

assembling a plurality of support members, each of which comprises a plurality of elongated blocks; said blocks being stacked in a abutting relationship to form a generally stepped structure with a broader base and a narrower top;

positioning said plurality of support members beneath said mobile home structure in a generally horizontal plane with the longitudinal axis of some of said members being aligned at angles of 45° to 90° to the axis of others of said members; and placing said mobile home structure on said support members.

16. A method as in claim 15 comprising positioning said support members at angles of 45° to 90° to the longitudinal axis of said mobile home structure.

17. A method as in claim 16 comprising positioning at least some of said support members at about 90° to the longitudinal axis of said mobile home structure.

18. A method as in claim 15 comprising securing said mobile home structure directly to at least some of said support members.

19. A method as in claim 15 wherein said plurality of support member is positioned on 10 to 15 foot centers longitudinally of the mobile home structure and on 5 to 7 foot centers laterally.

* * * * *